US011588255B2

(12) United States Patent
Sato et al.

(10) Patent No.: US 11,588,255 B2
(45) Date of Patent: Feb. 21, 2023

(54) ELECTRIC WIRE WITH TERMINAL HAVING IMPROVED ANTICORROSION PERFORMANCE

(71) Applicant: Yazaki Corporation, Tokyo (JP)

(72) Inventors: Kei Sato, Shizuoka (JP); Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/370,234

(22) Filed: Jul. 8, 2021

(65) Prior Publication Data

US 2022/0021133 A1 Jan. 20, 2022

(30) Foreign Application Priority Data

Jul. 14, 2020 (JP) ..... JP2020-120287
Apr. 14, 2021 (JP) ..... JP2021-068060

(51) Int. Cl.

| | |
|---|---|
| ***H01R 4/18*** | (2006.01) |
| ***H01R 4/62*** | (2006.01) |
| ***H01R 43/048*** | (2006.01) |
| ***H01B 7/28*** | (2006.01) |
| ***H01R 4/70*** | (2006.01) |

(52) U.S. Cl.

CPC ..... *H01R 4/185* (2013.01); *H01B 7/28* (2013.01); *H01R 4/62* (2013.01); *H01R 4/70* (2013.01); *H01R 43/048* (2013.01)

(58) Field of Classification Search

CPC . H01R 4/185; H01R 4/62; H01R 4/70; H01R 43/048; H01B 7/28

USPC ..... 439/877

See application file for complete search history.

(56) References Cited

U.S. PATENT DOCUMENTS

| | | | | |
|---|---|---|---|---|
| 8,167,666 | B2 * | 5/2012 | Koga | H01R 43/048 439/852 |
| 9,022,818 | B2 * | 5/2015 | Onuma | H01R 4/188 439/877 |
| 9,028,283 | B2 * | 5/2015 | Sato | H01R 4/70 439/736 |
| 9,209,615 | B2 * | 12/2015 | Ono | H02G 15/046 |
| 9,391,384 | B2 * | 7/2016 | Kodama | H01R 4/62 |
| 9,647,382 | B2 * | 5/2017 | Nabeta | H01R 4/70 |
| 9,663,863 | B2 * | 5/2017 | Takata | C08F 255/04 |
| 10,355,373 | B2 * | 7/2019 | Iwasawa | H01R 4/70 |

(Continued)

FOREIGN PATENT DOCUMENTS

JP 2016-181387 A 10/2016

*Primary Examiner* — Peter G Leigh
(74) *Attorney, Agent, or Firm* — Sughrue Mion, PLLC

(57) ABSTRACT

An electric wire with terminal includes: an electric wire having a conductor part covered by an insulation sheath part; a crimp terminal including a conductor crimp part crimped to the conductor part, a sheath crimp part crimped to the insulation sheath part, and an intermediate part from which the conductor part is exposed, the intermediate part connecting the conductor crimp part and the sheath crimp part; and an anticorrosive material that covers the conductor part exposed from the crimp terminal. A terminal of the insulation sheath part on the conductor crimp part side is exposed toward the intermediate part side from the sheath crimp part. The crimp terminal includes a sheath cover wall part that covers an edge of the terminal of the insulation sheath part on a top view.

7 Claims, 6 Drawing Sheets

(56) References Cited

U.S. PATENT DOCUMENTS

| | | | | |
|---|---|---|---|---|
| 2014/0194003 | A1* | 7/2014 | Nabeta | H01R 13/5216<br>439/604 |
| 2019/0305440 | A1* | 10/2019 | Shinohara | H01R 13/03 |
| 2019/0305442 | A1* | 10/2019 | Shinohara | H01R 4/185 |

* cited by examiner

ELECTRIC WIRE WITH TERMINAL HAVING IMPROVED ANTICORROSION PERFORMANCE

CROSS-REFERENCE TO RELATED APPLICATION(S)

The present application claims priority to and incorporates by reference the entire contents of Japanese Patent Application No. 2020-120287 filed in Japan on Jul. 14, 2020 and Japanese Patent Application No. 2021-068060 filed in Japan on Apr. 14, 2021.

BACKGROUND OF THE INVENTION

1. Field of the Invention

The present invention relates to an electric wire with terminal.

2. Description of the Related Art

As a conventional electric wire with terminal, for example, Japanese Patent Application Laid-open No. 2016-181387 discloses an electric wire with terminal, which includes a covered electric wire, a terminal, and an ultraviolet-curable resin member. The covered electric wire includes an insulation sheath and a conductor exposed from the top end of the insulation sheath. The terminal includes a conductor crimp part for crimping the conductor, and a sheath crimp part for crimping the insulation sheath. The resin member covers at least the conductor exposed from the insulation sheath.

By the way, in regards to the electric wire with terminal disclosed in Japanese Patent Application Laid-open No. 2016-181387 mentioned above, there is room for further improvement in terms of securing a more appropriate anticorrosion performance, for example.

SUMMARY OF THE INVENTION

The present invention is designed in view of the aforementioned circumstances, and an object thereof is to provide an electric wire with terminal capable of securing a more proper anticorrosion performance.

In order to achieve the above mentioned object, an electric wire with terminal according to one aspect of the present invention includes an electric wire having a conductor part exhibiting conductivity covered by an insulation sheath part exhibiting an insulating property; a crimp terminal including a conductor crimp part crimped to the conductor part exposed from a terminal of the insulation sheath part, a sheath crimp part crimped to the insulation sheath part, and an intermediate part from which the conductor part is exposed along an exposing direction intersecting with an axial direction that is along an axis line of the electric wire, the intermediate part connecting the conductor crimp part and the sheath crimp part along the axial direction; and an anticorrosive material that covers the conductor part exposed from the crimp terminal, wherein the terminal of the insulation sheath part on a side of the conductor crimp part is exposed toward a side of the intermediate part from the sheath crimp part along the axial direction, and the crimp terminal includes a sheath cover wall part that covers an edge of the terminal of the insulation sheath part in a width direction intersecting with the axial direction and with the exposing direction on a top view when the conductor part exposed from the intermediate part is viewed from an exposed side of the conductor part along the exposing direction.

According to another aspect of the present invention, in the electric wire with terminal, it is possible to configure that the sheath crimp part includes a base extended along the axial direction with a plate-thickness direction of the base being along the exposing direction, and a pair of barrel pieces each being extended on both sides of a circumferential direction around the axis line from the base, the sheath crimp part being crimped by wrapping a whole circumference of the insulation sheath part in the circumferential direction with the base and the pair of barrel pieces, and the sheath cover wall part is provided from each of the barrel pieces to the intermediate part, respectively.

According to still another aspect of the present invention, in the electric wire with terminal, it is possible to configure that the conductor crimp part includes a base extended along the axial direction with a plate-thickness direction of the base being along the exposing direction, and a pair of barrel pieces each being extended on both sides of a circumferential direction around the axis line from the base, the conductor crimp part being crimped by wrapping a whole circumference of the conductor part in the circumferential direction with the base and the pair of barrel pieces, and the sheath cover wall part is provided from each of the barrel pieces to the intermediate part, respectively.

According to still another aspect of the present invention, in the electric wire with terminal, it is possible to configure that an end face of the intermediate part in a circumferential direction around the axis line faces toward the exposed side of the conductor part along the exposing direction, and the anticorrosive material covers also the end face of the intermediate part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments according to the present invention will be described in detail with reference to the accompanying drawings. Note that the present invention is not limited by the embodiments. Furthermore, structural elements in the following embodiments include elements that may be replaceable and may easily occur to those skilled in the art or elements that are substantially the same.

Figure 1:
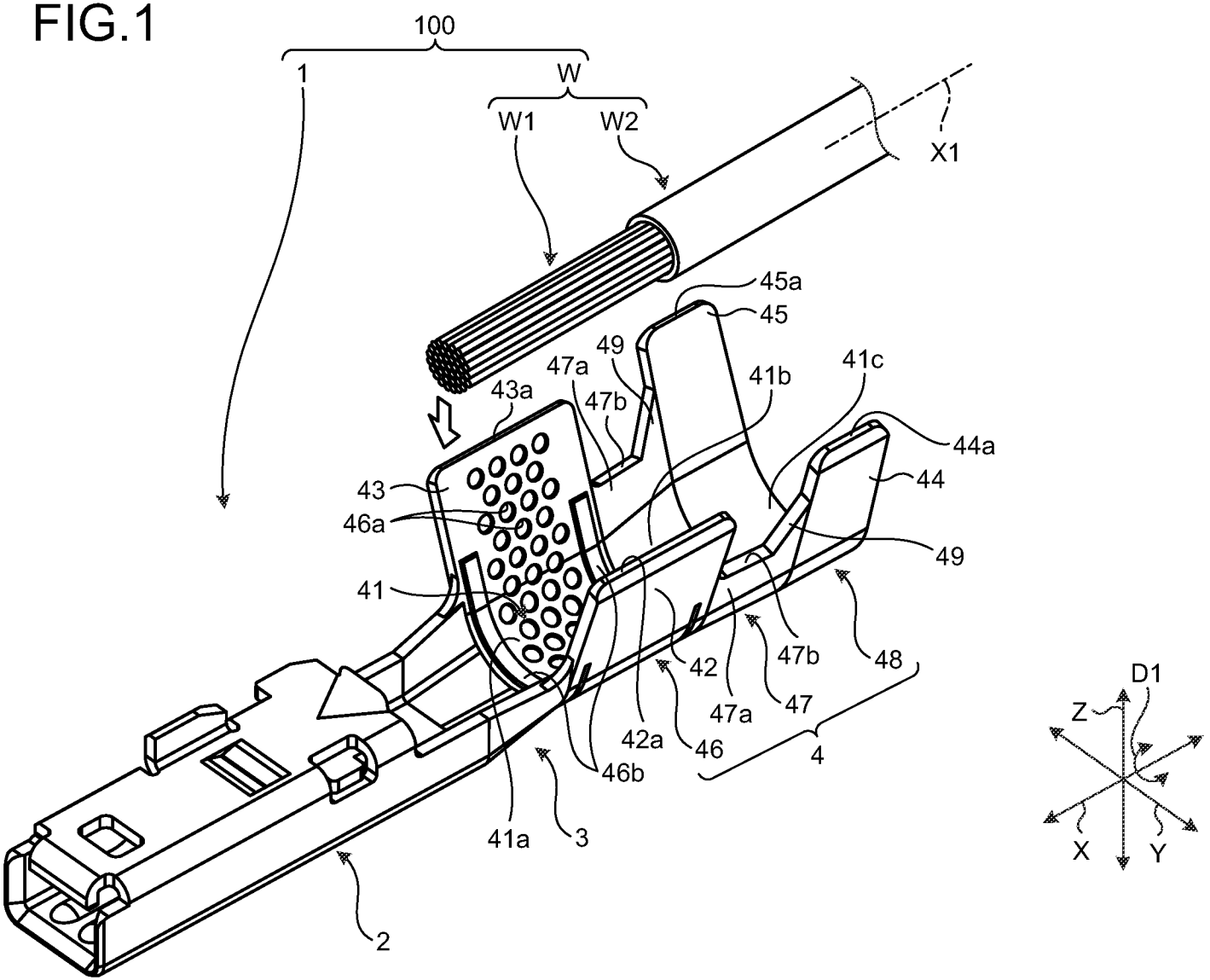
FIG. 1 is an exploded perspective view illustrating a schematic configuration of an electric wire with terminal according to a first embodiment.
Figure 2:
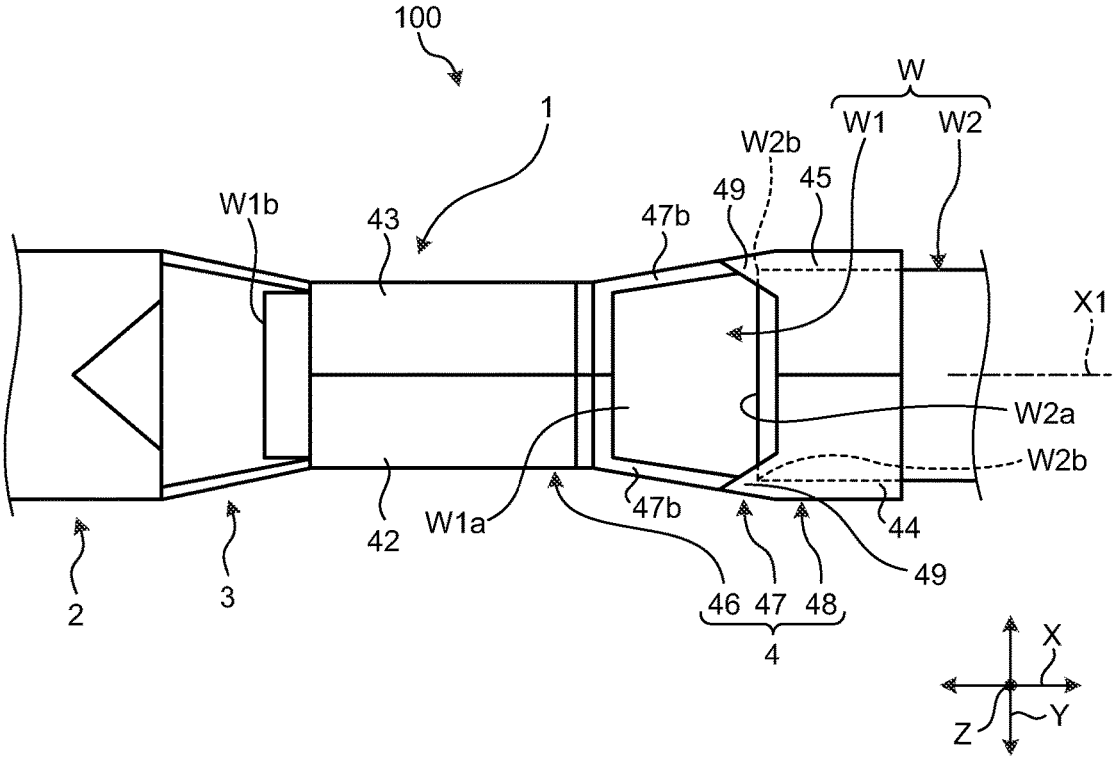
FIG. 2 is a schematic fragmentary plan view illustrating a schematic configuration of the electric wire with terminal according to the first embodiment before applying an anticorrosive material.
Figure 3:
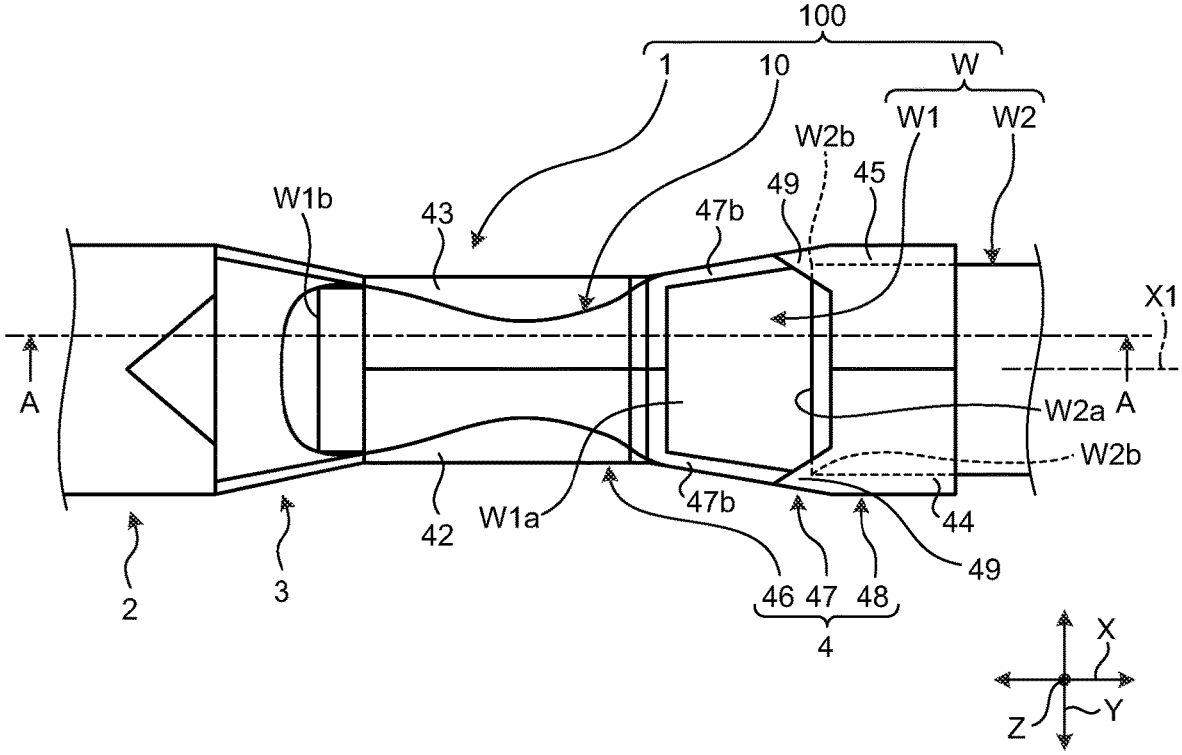
FIG. 3 is a schematic fragmentary plan view illustrating a schematic configuration of the electric wire with terminal according to the first embodiment after applying an anticorrosive material.
Figure 4:
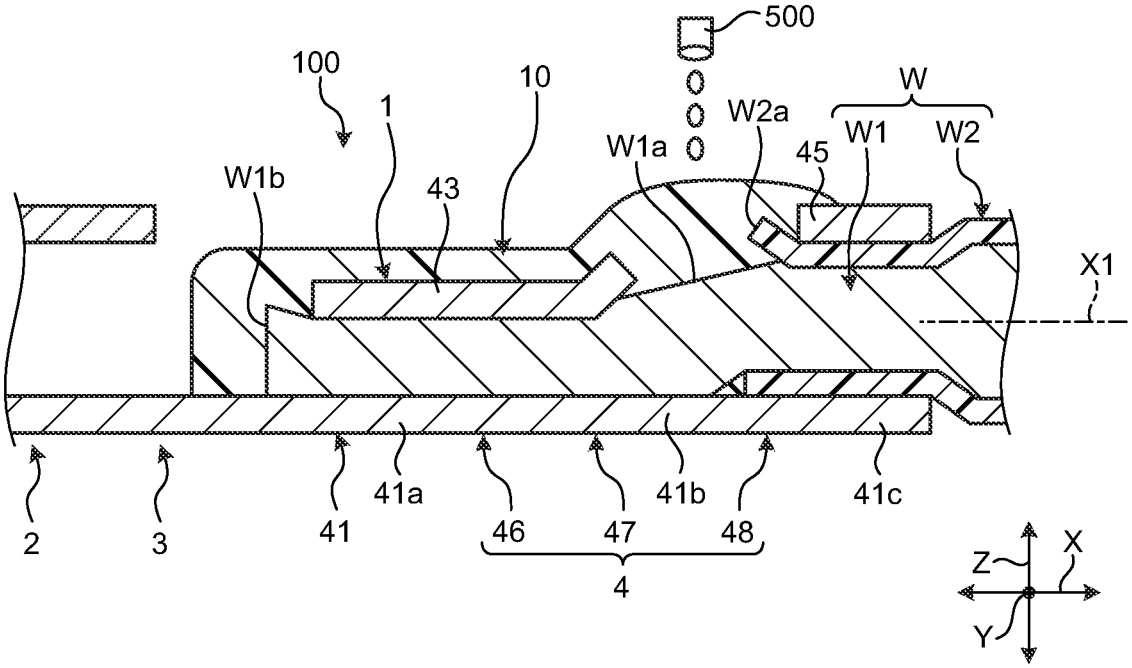
FIG. 4 is a schematic sectional view taken along line A-A illustrated in FIG. 3.
Figure 5:
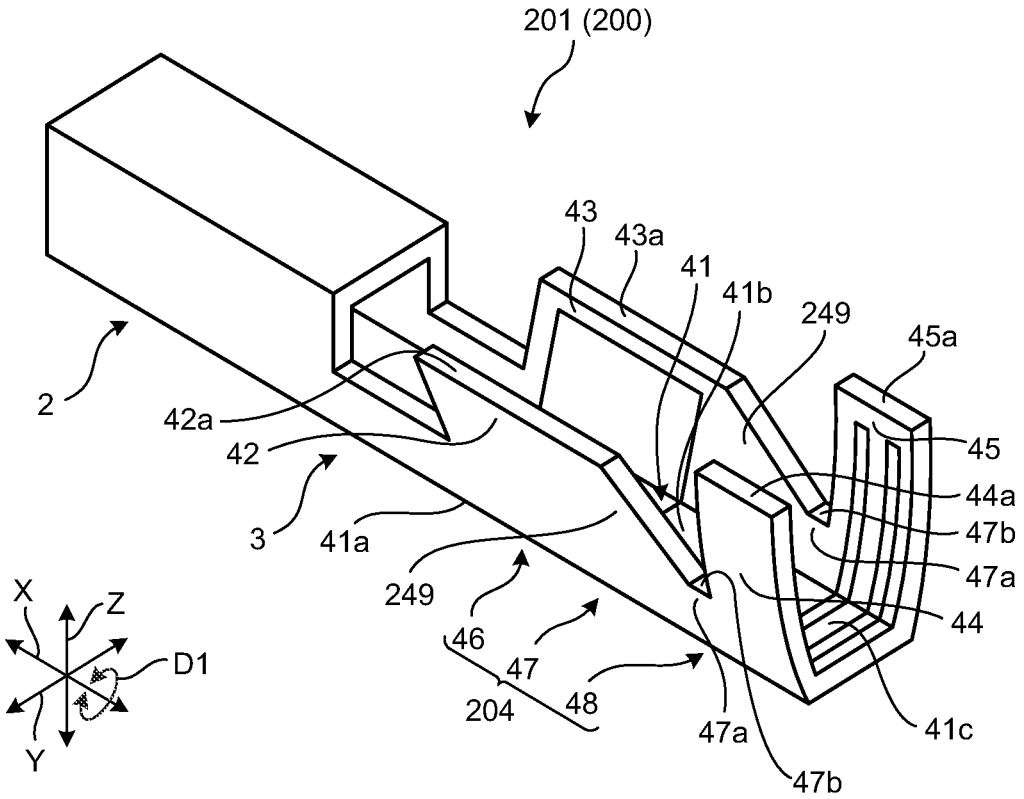
FIG. 5 is an exploded perspective view illustrating a schematic configuration of an electric wire with terminal according to a second embodiment.
Figure 6:
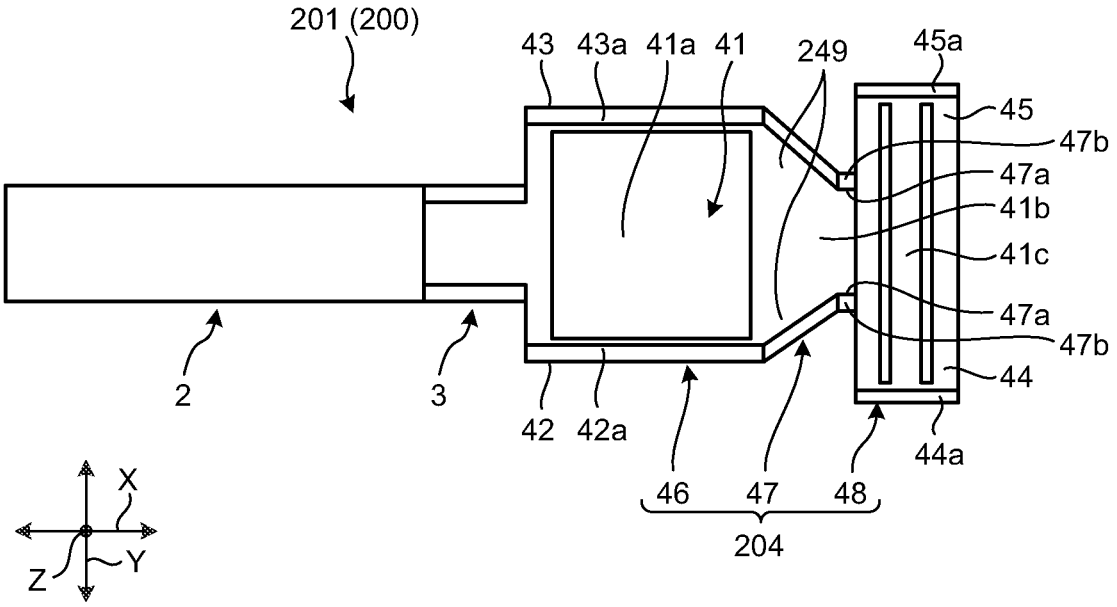
FIG. 6 is a schematic plan view illustrating an unfolded state of a crimp terminal of the electric wire with terminal according to the second embodiment.
Figure 7:
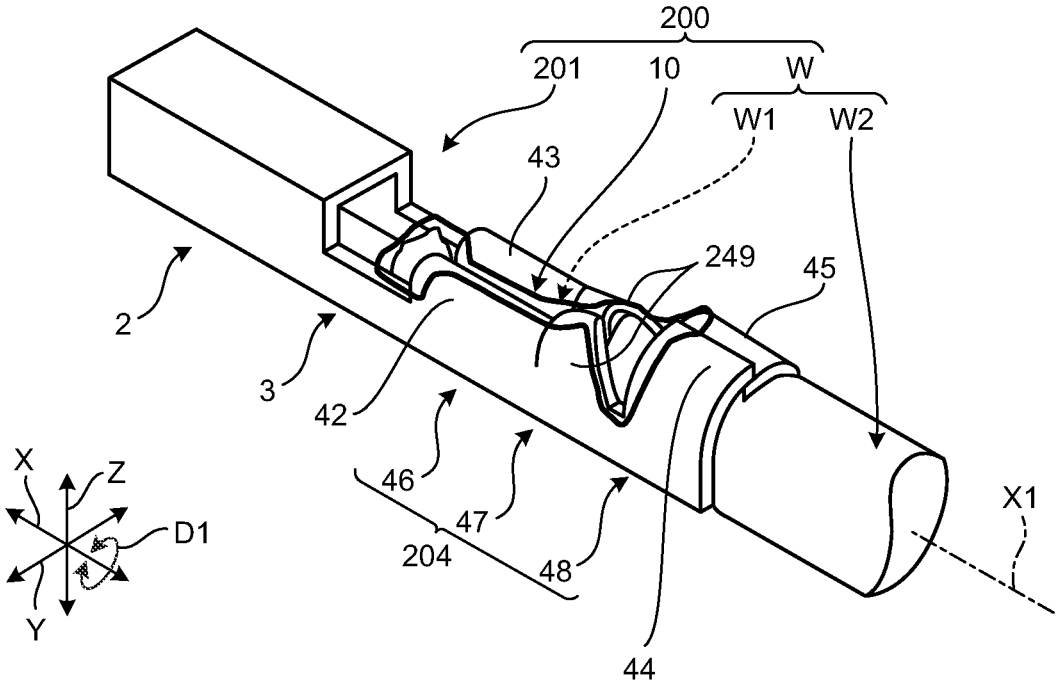
FIG. 7 is a perspective view illustrating a schematic configuration of the electric wire with terminal according to the second embodiment.

In the following explanations, among a first direction, a second direction, and a third direction intersecting with each other, the first direction is referred to as "axial direction X", the second direction is referred to as "width direction Y", and the third direction is referred to as "height direction Z". Note here that the axial direction X, the width direction Y, and the height direction Z herein are substantially orthogonal to each other. The axial direction X typically corresponds to a direction along an axis line X1 of an electric wire to which a crimp terminal is provided (see FIG. 1 and the like), an extending direction along which the electric wire is extended, insertion/removal directions of the crimp terminal and a counterpart terminal, or the like. The width direction Y and the height direction Z correspond to intersecting directions that intersect with the axial direction X. The height direction Z typically corresponds to a plate-thickness direction of a base part, an exposing direction to which a conductor part of the electric wire is exposed from an intermediate part of a crimp terminal, an applying direction of an anticorrosive material for the conductor part exposed from the intermediate part, or the like. In the explanations below, in a state after the crimp terminal is crimped, a direction around the axis line X1 is referred to as "circumferential direction D1". Furthermore, FIG. 1 illustrates a state before the crimp terminal is crimped. FIG. 2, FIG. 3, and FIG. 4 illustrate states after the crimp terminal is crimped. Note that each of the directions used in the explanations below indicates the direction in a state where each part is mutually assembled unless otherwise noted.

First Embodiment

An electric wire with terminal 100 according to the embodiment illustrated in FIG. 1, FIG. 2, FIG. 3, and FIG. 4 is applied to a wire harness and the like used in vehicles. Note that a wire harness is an assembly in which a plurality of electric wires W used for power supply and signal communication are bundled for connecting the electric wires W to each device by a connector or the like in order to connect each of the devices loaded on a vehicle, for example.

The electric wire with terminal 100 according to the embodiment includes: the electric wire W; a crimp terminal 1 crimped and conductively connected to the terminal of the electric wire W; and an anticorrosive material 10 that covers each part to prevent corrosion (see FIG. 3, FIG. 4). The crimp terminal 1 according to the embodiment configures a corrosion-proof terminal that is protected from corrosion by the anticorrosive material 10. The electric wire with terminal 100 according to the embodiment is designed to secure a more proper anticorrosion performance by providing, to the crimp terminal 1, a sheath cover wall part 49 to be in a prescribed positional relation with respect to an insulation sheath part W2 of the electric wire W. Hereinafter, each structure of the electric wire with terminal 100 will be described in detail by referring to each of the drawings.

The electric wire W is routed in a vehicle for electrically connecting each of the devices. The electric wire W is configured including: a linear conductor part W1 exhibiting conductivity; and the insulation sheath part W2 exhibiting an insulating property, which covers the outer side of the conductor part W1. The electric wire W is an insulated electric wire in which the conductor part W1 is covered by the insulation sheath part W2.

The conductor part W1 is a core wire in which a plurality of metal wires exhibiting conductivity are bundled. The conductor part W1 may also be a stranded core wire acquired by twisting the metal wires. The insulation sheath part W2 is an electric wire sheath that covers the outer circumference side of the conductor part W1. The insulation sheath part W2 is formed by extrusion-molding an insulating resin material (PP, PVC, crosslinked PE, or the like, which is selected as appropriate by considering abrasion resistance, chemical resistance, heat resistance, and the like), for example.

The electric wire W is formed to extend linearly along the axis line X1 and to extend toward the extending direction (the axial direction X) almost in the same diameter. The electric wire W has a substantially circular sectional shape as a whole in which the sectional shape of the conductor part W1 (the sectional shape in a direction intersecting with the axial direction X) is in a substantially circular shape and the sectional shape of the insulation sheath part W2 is in a substantially annular shape. At least in one terminal of the electric wire W, the insulation sheath part W2 is stripped off so that the conductor part W1 is exposed from the insulation sheath part W2. The electric wire W has the crimp terminal 1 provided at the terminal of the conductor part W1 that is exposed from the insulation sheath part W2.

The crimp terminal 1 is a terminal metal fitting to which the electric wire W is electrically connected and a counterpart terminal exhibiting conductivity is connected. The crimp terminal 1 includes an electrical connection part 2, a joint part 3, and a wire crimp part 4. The electrical connection part 2, the joint part 3, and the wire crimp part 4 are configured integrally as a whole with a metal member exhibiting conductivity. For example, the crimp terminal 1 is formed by performing various kinds of processing such as punching, pressing, bending, and the like on a single metal sheet in accordance with shapes of each of the electrical connection part 2, the joint part 3, the wire crimp part 4, and the like so as to integrally form each of the parts three-dimensionally. As for the crimp terminal 1, the electrical connection part 2, the joint part 3, and the wire crimp part 4 are mutually connected in this order from one side toward the other side along the axial direction X.

The electrical connection part 2 is the part that is electrically connected to the counterpart terminal. The electrical connection part 2 may be in a male terminal shape or in a female terminal shape. The electrical connection part 2 of the embodiment is illustrated to be in a female terminal shape, and it is electrically connected to a counterpart terminal in a male terminal shape. Note that the electrical connection part 2 may be configured to be electrically connected to various kinds of conductive members such as an earth member, not limited to the counterpart terminal. In this case, the electrical connection part 2 may be in the so-called ring terminal (LA terminal) fastened to the earth member or the like, for example.

The joint part 3 is a part interposed between the electrical connection part 2 and the wire crimp part 4 so as to connect the electrical connection part 2 and the wire crimp part 4 to be conductive. As for the crimp terminal 1, the electrical connection part 2 and the wire crimp part 4 are electrically connected via the joint part 3, and the electrical connection part 2 and the conductor part W1 of the electric wire W are electrically connected to be conductive via the wire crimp part 4.

The wire crimp part 4 is a part to which the electric wire W is connected, which electrically connects the terminal of the electric wire W and the crimp terminal 1. The wire crimp part 4 is provided to the terminal of the electric wire W by being swaged and crimped thereto. The wire crimp part 4 is configured including a base 41 and two pairs of barrel pieces 42 and 43, and 44 and 45. The wire crimp part 4 is swaged and crimped to the electric wire W with the base 41 and the two pairs of barrel pieces 42 and 43, and 44 and 45.

In more detail, in the wire crimp part 4, the base 41 and the two pairs of barrel pieces 42 and 43, and 44 and 45 configure a conductor crimp part 46, an intermediate part 47, and a sheath crimp part 48. In other words, the wire crimp part 4 is configured including the conductor crimp part 46, the intermediate part 47, and the sheath crimp part 48 configured with the base 41 and the two pairs of barrel pieces 42 and 43, and 44 and 45.

The conductor crimp part 46 is configured with a part of the base 41 and the pair of barrel pieces 42 and 43. The intermediate part 47 is configured with a part of the base 41. The sheath crimp part 48 is configured with a part of the base 41 and the pair of barrel pieces 44 and 45. As for the wire crimp part 4, the conductor crimp part 46, the intermediate part 47, and the sheath crimp part 48 are mutually connected in this order from the electrical connection part 2 side toward the opposite side along the axial direction X. Furthermore, the wire crimp part 4 of the embodiment configures the so-called separate barrel type crimp part in which the pair of barrel pieces 42 and 43 and the pair of barrel pieces 44 and 45 are separated via the intermediate part 47.

Specifically, the base 41 is a part extended along the axial direction X to be a bottom wall of the wire crimp part 4 formed in a substantially U-like shape in a state before the crimp terminal 1 is crimped. The base 41 is formed in a plate shape with its plate-thickness direction being along the height direction Z. On the base 41, the end of the electric wire W is placed at the time of crimp processing. The electrical connection part 2 is connected to one side of the base 41 in the axial direction X via the joint part 3. Both ends of the base 41 in the width direction Y in each of the parts are erected along the height direction Z.

More specifically, the base 41 continues through the conductor crimp part 46, the intermediate part 47, and the sheath crimp part 48 along the axial direction X. That is, the base 41 is configured with a first base part 41*a* that configures the conductor crimp part 46, a second base part 41*b* that configures the intermediate part 47, and a third base part 41*c* that configures the sheath crimp part 48 continuously formed along the axial direction X. In the base 41, the electrical connection part 2 is connected to one end of the first base part 41*a* in the axial direction X. Furthermore, in a state before the crimp processing, the base 41 has a carrier connected to the other end of the third base part 41*c* in the axial direction X, and it is separated from the carrier at the time of the crimp processing, for example.

The pair of barrel pieces 42 and 43 is the part configuring the conductor crimp part 46 together with the first base part 41*a* that is a part of the base 41. The conductor crimp part 46 is the part that is electrically connected to the conductor part W1 by being swaged and crimped to the conductor part W1 of the electric wire W. The conductor crimp part 46 is provided on one end side of the wire crimp part 4 in the axial direction X, which herein is on the electrical connection part 2 side.

Each of the pair of barrel pieces 42 and 43 is a part extended and formed in a belt-like shape on both sides of the width direction Y (a circumferential direction D1 in a state after being crimped) from the first base part 41*a* in the conductor crimp part 46 to be swaged and crimped by wrapping the conductor part W1 of the electric wire W with the first base part 41*a*. The pair of barrel pieces 42 and 43 is the part to be the sidewalls of the wire crimp part 4 formed in a U-like shape in a state before the crimp processing. The barrel piece 42 is extended from the first base part 41*a* toward one side of the width direction Y. The other barrel piece 43 is extended from the first base part 41*a* toward the other side of the width direction Y. In a state before swaged and crimped to the conductor part W1 of the electric wire W, the pair of barrel pieces 42 and 43 together with the first base part 41*a* is formed in a substantially U-like shape by performing bend processing on the first base part 41*a*.

The pair of barrel pieces 42 and 43 of the embodiment has a length defined from the root on the first base part 41*a* side to the top end such that top ends 42*a* and 43*a* thereof do not overlap with each other in a state of being wound around, and swaged and crimped to the conductor part W1. The conductor crimp part 46 wraps the outer side of the conductor part W1 of the electric wire W disposed between the pair of barrel pieces 42 and 43 with the first base part 41*a* and the pair of barrel pieces 42 and 43, and it is swaged and crimped to the conductor part W1.

For the pair of barrel pieces 42 and 43 of the embodiment, swaging/crimping such as the so-called B-crimp is employed. With the B-crimp, each of the pair of barrel pieces 42 and 43 is folded toward the first base part 41*a* side in a state where the conductor crimp part 46 is crimped by wrapping the whole circumference of the conductor part W1 in the circumferential direction D1 with the first base part 41*a* and the pair of barrel pieces 42 and 43. In this state, the conductor crimp part 46 is swaged and crimped with each of the top ends 42*a*, 43*a* of the pair of barrel pieces 42 and 43 being in contact and pressed against the conductor part W1.

Note that the conductor crimp part 46 may include, on the inner face of the conductor crimp part 46, a serration 46*a*, an indentation 46*b*, and the like for improving the contact stability and adhesion strength by increasing the contact area with respect to the conductor part W1. Note here that the inner face of the conductor crimp part 46 is the face on the side that contacts with the conductor part W1 in the first base part 41*a* and the pair of barrel pieces 42 and 43. Furthermore, the conductor crimp part 46 is not limited to the above-described manner, and may be subjected to swaging/crimping such as so-called overlap crimp, for example. With overlap crimp, the conductor crimp part 46 is configured such that the top ends 42*a* and 43*a* overlap with each other in a state where the pair of barrel pieces 42 and 43 is wound around, and swaged and crimped to the electric wire W.

The pair of barrel pieces 44 and 45 is a part that configures the sheath crimp part 48 together with the third base part 41*c* that is a part of the base 41. The sheath crimp part 48 is a part that is fixed to the insulation sheath part W2 by being swaged and crimped to the insulation sheath part W2 of the electric wire W. The sheath crimp part 48 is provided on the other end side of the wire crimp part 4 in the axial direction X, which herein is on the opposite side of the electrical connection part 2 side.

Each of the pair of barrel pieces 44 and 45 is a part formed in a belt-like shape on both sides of the width direction Y (the circumferential direction D1 in a state after being crimped) from the third base part 41*c* in the sheath crimp part 48 to be swaged and crimped by wrapping the insulation sheath part W2 of the electric wire W with the third base part 41*c*. The pair of barrel pieces 44 and 45 is the part to be the sidewalls of the wire crimp part 4 formed in a U-like shape in a state before the crimp processing. The barrel piece 44 is extended from the third base part 41*c* toward one side of the width direction Y. The other barrel piece 45 is extended from the third base part 41*c* toward the other side of the width direction Y. In a state before swaged and crimped to the insulation sheath part W2 of the electric wire W, the pair of barrel pieces 44 and 45 together with the third base part 41*c* is formed in a substantially U-like shape by performing bend processing on the third base part 41*c*.

The pair of barrel pieces 44 and 45 of the embodiment has the length defined from the root on the third base part 41*c* side to the top end such that top ends 44*a* and 45*a* thereof do not overlap with each other in a state of being wound around, and swaged and crimped to the insulation sheath part W2. The sheath crimp part 48 wraps the outer side of the insulation sheath part W2 of the electric wire W disposed between the pair of barrel pieces 44 and 45 with the third base part 41*c* and the pair of barrel pieces 44 and 45, and is swaged and crimped to the insulation sheath part W2.

For the pair of barrel pieces 44 and 45 of the embodiment, swaging/crimping such as the so-called overlap crimp is employed. With the overlap crimp, the top ends 44*a* and 45*a* sides overlap with each other in a state where the sheath crimp part 48 is crimped by wrapping the whole circumference of the insulation sheath part W2 in the circumferential direction D1 with the third base part 41*c* and the pair of barrel pieces 44 and 45.

Note that the sheath crimp part 48 is not limited to the above-described manner, and may be subjected to swaging/crimping such as so-called round crimp, for example. With the round crimp, the sheath crimp part 48 is swaged and crimped in a positional relation where the top ends 44*a* and 45*a* of the pair of barrel pieces 44 and 45 oppose and abut against each other in a state of being crimped by wrapping the insulation sheath part W2 with the third base part 41*c* and the pair of barrel pieces 44 and 45.

Note here that in the wire crimp part 4, the intermediate part 47 is interposed between the sheath crimp part 48 and the conductor crimp part 46 with respect to the axial direction X. The intermediate part 47 is the part interposed between the conductor crimp part 46 and the sheath crimp part 48 to connect the conductor crimp part 46 and the sheath crimp part 48 along the axial direction X. The intermediate part 47 is configured with the second base part 41*b*, the first base part 41*a* of the conductor crimp part 46 is connected to the end on one side of the second base part 41*b* in the axial direction X, and the third base part 41*c* of the sheath crimp part 48 is connected to the end on the other side. As for the intermediate part 47, both ends of the second base part 41*b* are erected along the height direction Z to form rising end parts 47*a*. Each of the rising end parts 47*a* in a state after the crimp terminal 1 is crimped to the electric wire W has its end face 47*b* in the circumferential direction D1 facing toward one side along the height direction Z. The intermediate part 47 configures the part where an intermediate exposed part W1*a* of the conductor part W1 is exposed from the crimp terminal 1. As for the intermediate part 47, the intermediate exposed part W1*a* of the conductor part W1 is exposed toward one side along the height direction Z from between each of the end faces 47*b* of the rising end parts 47*a*. The exposing direction to which the intermediate exposed part W1*a* of the conductor part W is exposed from the intermediate part 47 is along the height direction Z. That is, each of the end faces 47*b* of the rising end parts 47*a* faces toward the exposed side of the intermediate exposed part W1*a* (the side where the intermediate exposed part W1*a* is exposed) along the exposing direction (the height direction Z). Furthermore, as for the intermediate part 47, a terminal W2*a* of the insulation sheath part W2 on the conductor crimp part 46 side is also exposed. As for the insulation sheath part W2, the terminal W2*a* on the conductor crimp part 46 side is exposed from the sheath crimp part 48 toward the intermediate part 47 side along the axial direction X. As described above, the pair of barrel pieces 42 and 43 and the pair of the barrel pieces 44 and 45 are formed by being separated from each other with a space provided therebetween with the intermediate part 47 interposed therebetween.

The crimp terminal 1 configured in the manner described above is crimped to the terminal of the electric wire W by crimping the conductor crimp part 46 to the conductor part W1 and crimping the sheath crimp part 48 to the insulation sheath part W2. In this state, a contact area is formed between the conductor crimp part 46 and the conductor part W1, so that the crimp terminal 1 is conductively connected to the conductor part W1 of the electric wire W via the contact area. Then, the crimp terminal 1 is held by a connector housing or the like, for example, and the connector housing is mutually fitted to a connector housing of a counterpart connector to be electrically connected to the counterpart terminal, thereby forming the electrical contact area therebetween. As a result, the crimp terminal 1 is conductively connected to the counterpart terminal via the connection area.

Note here that there may be a case where the conductor part W1 of the electric wire W to which the crimp terminal 1 is crimped is formed with aluminum (Al), an aluminum alloy, or the like, for example. That is, in that case, the conductor part W1 is a core wire in which a plurality of metal wires formed with aluminum or an aluminum alloy are bundled. Meanwhile, there may be a case where the crimp terminal 1 is formed by plating tin (Sn) or the like on a surface of a base material formed with a dissimilar metal different from the conductor part W1, such as copper (Cu) or a copper alloy. In that case, because the material of the conductor part W1 in the electric wire with terminal 100 is aluminum or an aluminum alloy and the material of the crimp terminal 1 thereof is copper or a copper alloy, galvanic corrosion may be caused between the conductor part W1 and the crimp terminal 1 due to a difference in ionization tendency of both when water (salt water) or the like enters therebetween. Note that the aluminum alloy mentioned above is an alloy containing aluminum as the main component. Furthermore, the copper alloy mentioned above is an alloy containing copper as the main component, and includes the so-called brass or the like, for example.

For that, the electric wire with terminal 100 of the embodiment has an anticorrosive material 10 for preventing corrosion applied to the wire crimp part 4 so as to suppress galvanic corrosion mentioned above. The electric wire with terminal 100 of the embodiment is protected from corrosion by covering the conductor part W1 exposed from the crimp terminal 1 with the anticorrosive material 10. The anticorrosive material 10 is formed with a UV (Ultraviolet rays) curable resin that is cured by irradiation of ultraviolet rays, for example. Although not limited thereto, an urethane acrylate resin may be used as the UV curable resin, for example. As for the anticorrosive material 10, after applying a paste-type UV curable resin to a prescribed part, ultraviolet rays are irradiated to cure and keep the shape. Herein, the anticorrosive material 10 is provided over the conductor crimp part 46, the intermediate part 47, the sheath crimp part 48, and the conductor part W1 exposed from the crimp terminal 1. That is, the anticorrosive material 10 herein is provided over a top end W1*b* of the conductor part W1 that is exposed from the crimp terminal 1, the conductor crimp part 46, the intermediate exposed part W1*a* exposed from the intermediate part 47, and the sheath crimp part 48 along the axial direction X. Furthermore, the anticorrosive material 10 is provided to penetrate also into the inner side of the wire crimp part 4 and between the wires of the conductor part W1. The anticorrosive material 10 after being applied to each of the parts and penetrated thereto becomes cured by irradiation of ultraviolet rays so as to keep the shape and to cover each of the parts. With such a configuration, the crimp terminal 1 keeps out water by the anticorrosive material 10 so as to restrict intrusion of water (salt water and the like) into the inside, so that it is possible to suppress occurrence of galvanic corrosion and the like.

Furthermore, in the configuration where the anticorrosive material 10 is provided as described above, the electric wire with terminal 100 of the embodiment is provided with the sheath cover wall parts 49 to cover a part of the terminal W2*a* of the insulation sheath part W2 exposed toward the intermediate part 47 side from the sheath crimp part 48 along the axial direction X. With such a configuration, it is possible to properly apply the anticorrosive material 10 for the crimp terminal 1 of the electric wire with terminal 100 according to the embodiment and to securely suppress the occurrence of galvanic corrosion described above.

Specifically, the wire crimp part 4 of the crimp terminal 1 according to the embodiment is configured including the sheath cover wall parts 49.

The sheath cover wall parts 49 are formed as the wall parts that cover edges W2*b* of the terminal W2*a* of the insulation sheath part W2 in the width direction Y on a top view of the crimp terminal 1 illustrated in FIG. 2 and FIG. 3.

Note here that the top view of the crimp terminal 1 illustrated in FIG. 2 and FIG. 3 corresponds to a top view when the intermediate exposed part W1*a* of the conductor part W1 exposed from the intermediate part 47 is viewed from the exposed side of the conductor part W1 along the exposing direction (the height direction Z). Furthermore, the exposed side of the conductor part W1 in the exposing direction (the height direction Z) corresponds, in other words, to the opposite side of the height direction Z from the side where the second base part 41*b* is positioned and corresponds to the side directly facing the intermediate exposed part W1*a* along the exposing direction (the height direction Z). Moreover, the exposed side of the conductor part W1 in the exposing direction (the height direction Z) typically corresponds to the side where, in the height direction Z, an application nozzle 500 for discharging the anticorrosive material 10 toward the intermediate exposed part W1*a* is positioned when applying the anticorrosive material 10 to the intermediate exposed part W1*a* as illustrated in FIG. 4.

There are a total of two sheath cover wall parts 49 with one each being provided by corresponding to the edges W2*b* on both sides in the width direction Y of the terminal W2*a* of the insulation sheath part W2 on the top view (FIG. 2, FIG. 3) of the crimp terminal 1 defined in the manner described above. Herein, one each of the sheath cover wall parts 49 is provided over each of the barrel pieces 44 and 45 configuring the sheath crimp part 48 and the intermediate part 47 as illustrated in FIG. 1. More specifically, each of the sheath cover wall parts 49 is formed in a substantially triangular shape from the base end of each of the barrel pieces 44 and 45 on the third base part 41*c* side (end on the opposite side from the top ends 44*a* and 45*a* side) to the end face 47*b* of each of the rising end parts 47*a* of the intermediate part 47.

One of the sheath cover wall parts 49 is provided from the barrel piece 44 to the end face 47*b* of the rising end part 47*a* on the barrel piece 44 side to cover the edge W2*b* of the terminal W2*a* of the insulation sheath part W2 on the barrel piece 44 side on the top view (FIG. 2, FIG. 3) of the crimp terminal 1 after the crimp terminal 1 is crimped to the electric wire W. The other sheath cover wall part 49 is provided from the barrel piece 45 to the end face 47*b* of the rising end part 47*a* on the barrel piece 45 side to cover the edge W2*b* of the terminal W2*a* of the insulation sheath part W2 on the barrel piece 45 side on the top view (FIG. 2, FIG. 3) of the crimp terminal 1 after the crimp terminal 1 is crimped to the electric wire W.

With such a configuration, on the top view of the crimp terminal 1 illustrated in FIG. 2 and FIG. 3, the terminal W2*a* of the insulation sheath part W2 is positioned within a range of the sheath cover wall parts 49 with respect to the axial direction X, and the edges W2*b* of the terminal W2*a* are positioned on the inner side of the sheath cover wall parts 49.

In the electric wire with terminal 100 configured in the manner described above, the edges W2*b* of the terminal W2*a* of the insulation sheath part W2 exposed from the intermediate part 47 are covered by each of the sheath cover wall parts 49, so that it is possible to prevent the edges W2*b* from covering over the end faces 47*b* side of the intermediate part 47. With the electric wire with terminal 100 having such a configuration, there is no edges W2*b* of the insulation sheath part W2 interposed between the application nozzle 500 (see FIG. 4) and each of the end faces 47*b* in the height direction Z, when applying the anticorrosive material 10 to the intermediate exposed part W1*a*, for example. As a result, the anticorrosive material 10 can be applied properly on the whole surface of each of the end faces 47*b*. Therefore, the anticorrosive material 10 of the embodiment can be applied so as to cover also the whole surface of the end faces 47*b* of the intermediate part 47 together with the intermediate exposed part W1*a*, so that the end faces 47*b* can also be protected from corrosion properly.

In the electric wire with terminal 100 described above, the crimp terminal 1 is crimped to the electric wire W by crimping the conductor crimp part 46 to the conductor part W1 and crimping the sheath crimp part 48 to the insulation sheath part W2. Furthermore, in the electric wire with terminal 100, the conductor part W1 exposed from the crimp terminal 1 is covered by the anticorrosive material 10 to be protected from corrosion. In the electric wire with terminal 100 with such a configuration, the terminal W2*a* of the insulation sheath part W2 together with the conductor part W1 of the electric wire W are exposed in the intermediate part 47 that connects the conductor crimp part 46 and the sheath crimp part 48. For example, with the electric wire with terminal 100, it is possible to perform various kinds of inspections regarding product management such as monitoring of poor crimping by checking the state of the terminal W2*a* of the insulation sheath part W2 exposed in the intermediate part 47.

Furthermore, in the electric wire with terminal 100, on a top view when the conductor part W1 exposed from the intermediate part 47 is viewed from the exposed side of the conductor part W1 along the exposing direction (the height direction Z), the edges W2*b* in the width direction Y of the terminal W2*a* of the insulation sheath part W2 exposed in the intermediate part 47 are covered by the sheath cover wall parts 49. As for the electric wire with terminal 100, the terminal W2*a* of the insulation sheath part W2 tends to be spread toward the outer side in the width direction Y because the insulation sheath part W2 is also pressed when crimping the crimp terminal 1 to the electric wire W, for example. However, spread of the edges W2*b* of the terminal W2*a* can be suppressed by the sheath cover wall parts 49. In the electric wire with terminal 100 with such a configuration, the part including the conductor part W1 exposed from the crimp terminal 1 can be properly covered by the anticorrosive material 10 without being hindered by the edges W2*b* of the terminal W2*a* of the insulation sheath part.

For example, with the electric wire with terminal 100, it is possible to prevent the anticorrosive material 10 before being cured from dripping to the outer surface or the like of the intermediate part 47 via the edges W2*b* of the terminal W2*a* of the insulation sheath part when applying the anticorrosive material 10 to the conductor part W1 exposed from the crimp terminal 1. As a result, with the electric wire with terminal 100, when inserting the crimp terminal 1 into a defined space such as a cavity of a connector housing, for example, it is possible to suppress interference of the anticorrosive material 10 protruded to the outer surface and the like of the intermediate part 47 with the peripheral structures so as to properly house the crimp terminal 1 in the defined space.

Moreover, with the electric wire with terminal 100 of the embodiment, it is possible to restrict intrusion of water (salt water) and the like into the inner side of the wire crimp part 4 by properly covering the conductor part W1 exposed from the crimp terminal 1 with the anticorrosive material 10. As described above, if the material of the conductor part W1 is aluminum and the material of the crimp terminal 1 is copper and water enters therebetween, the conductor part W1 of the electric wire with terminal 100 may be corroded (galvanic corrosion) due to a difference in the ionization tendency. For that, the electric wire with terminal 100 can restrict intrusion of water in the manner described above, so that the occurrence of such corrosion can be suppressed. As a result, the electric wire with terminal 100 can secure a proper anticorrosion performance.

Note here that in the electric wire with terminal 100 described above, the sheath cover wall part 49 is provided, respectively, from each of the barrel pieces 44 and 45 configuring the sheath crimp part 48 to the intermediate part 47. In the electric wire with terminal 100 with such a configuration, the edges W2*b* of the terminal W2*a* of the insulation sheath part W2 exposed in the intermediate part 47 can be properly covered by each of the sheath cover wall parts 49 so that a proper anticorrosion performance can be secured as described above.

Furthermore, as described above, the electric wire with terminal 100 may be configured to have no edges W2*b* of the insulation sheath part W2 interposed between the end faces 47*b* of each of the rising end parts 47*a* of the intermediate part 47 and the application nozzle 500 in the height direction Z, when applying the anticorrosive material 10 to the intermediate exposed part W1*a*. Therefore, with the electric wire with terminal 100, the anticorrosive material 10 can be easily applied over the whole surface of each of the end faces 47*b* as well. Note here that the end face 47*b* of each of the rising end parts 47*a* of the intermediate part 47 is typically a face configuring a shear plane formed by press work or the like, from which the base material of the crimp terminal 1 is exposed. If the material of the conductor part W1 is aluminum and the base material of the crimp terminal 1 is copper as described above, the electric wire with terminal 100 tends to have galvanic corrosion described above generated in the end faces 47*b* of each of the rising end parts 47*a* where the copper as the base material is exposed. For that, it is possible with the electric wire with terminal 100 to apply the anticorrosive material 10 to cover also the end faces 47*b* of the intermediate part 47 together with the intermediate exposed part W1*a*, so that corrosion can be suppressed in the area in the vicinity of the end faces 47*b* where galvanic corrosion tends to occur. As a result, the electric wire with terminal 100 can secure a more proper anticorrosion performance.

Second Embodiment

An electric wire with terminal according to a second embodiment is different from that of the first embodiment in terms of the position of the sheath cover wall parts. Hereinafter, common reference signs are applied to the structural elements similar to those of the embodiment described above, and duplicated explanations for the common structures, actions, and effects are avoided as much as possible.

An electric wire with terminal 200 of the embodiment illustrated in FIG. 5, FIG. 6, FIG. 7, FIG. 8, FIG. 9, FIG. 10, and FIG. 11 is different from the above-described electric wire with terminal 200 in respect that a crimp terminal 201 is provided instead of the crimp terminal 1. The crimp terminal 201 is different from the above-described crimp terminal 1 in respect that it includes a wire crimp part 204 instead of the wire crimp part 4. The wire crimp part 204 is different from the above-described wire crimp part 4 in respect that it is configured including sheath cover wall parts 249 instead of the sheath cover wall parts 49. The wire crimp part 204 of the crimp terminal 201 according to the embodiment is configured including the sheath cover wall parts 249. Roughly, other configurations of the electric wire with terminal 200, the crimp terminal 201, the wire crimp part 204, and the sheath cover wall parts 249 are substantially the same as those of the electric wire with terminal 100, the crimp terminal 1, the wire crimp part 4, and the sheath cover wall parts 49 even though presence of serrations and indentations as well as detailed shapes are slightly different.

Figure 8:
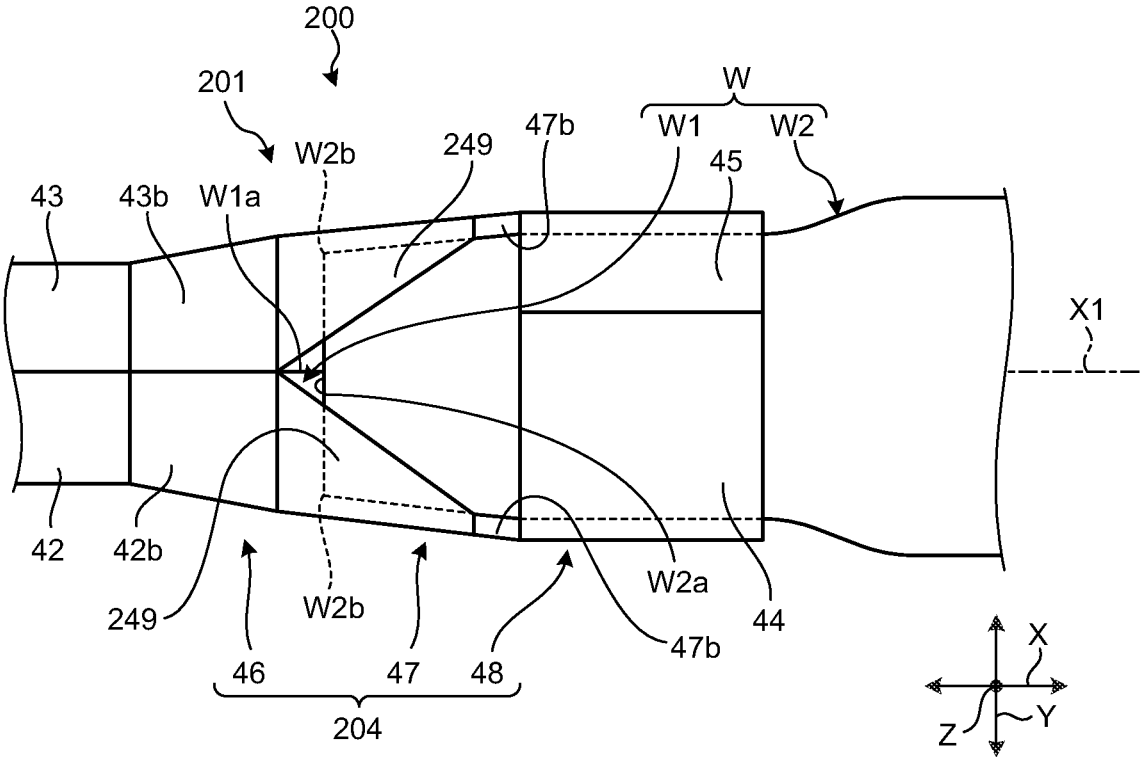
FIG. 8 is a schematic fragmentary plan view illustrating a schematic configuration of the electric wire with terminal according to the second embodiment before applying an anticorrosive material.
Figure 9:
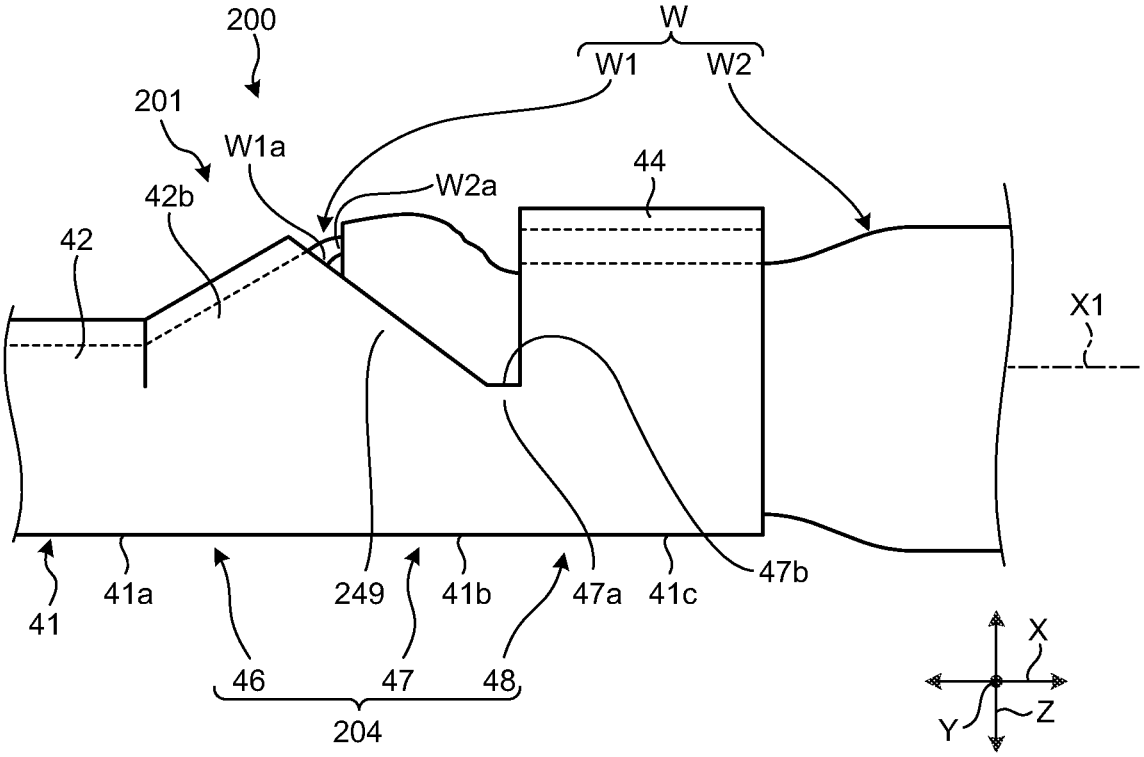
FIG. 9 is a schematic fragmentary side view illustrating a schematic configuration of the electric wire with terminal according to the second embodiment after applying an anticorrosive material.
Figure 10:
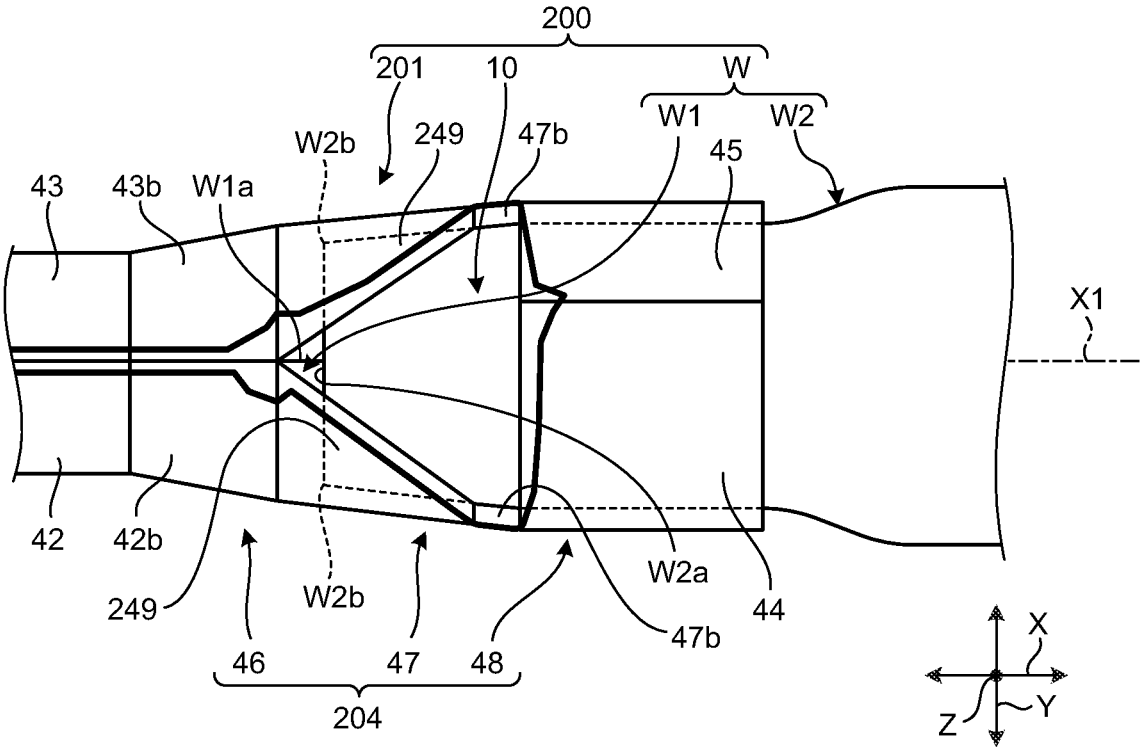
FIG. 10 is a schematic fragmentary plan view illustrating a schematic configuration of the electric wire with terminal according to the second embodiment after applying an anticorrosive material.
Figure 11:
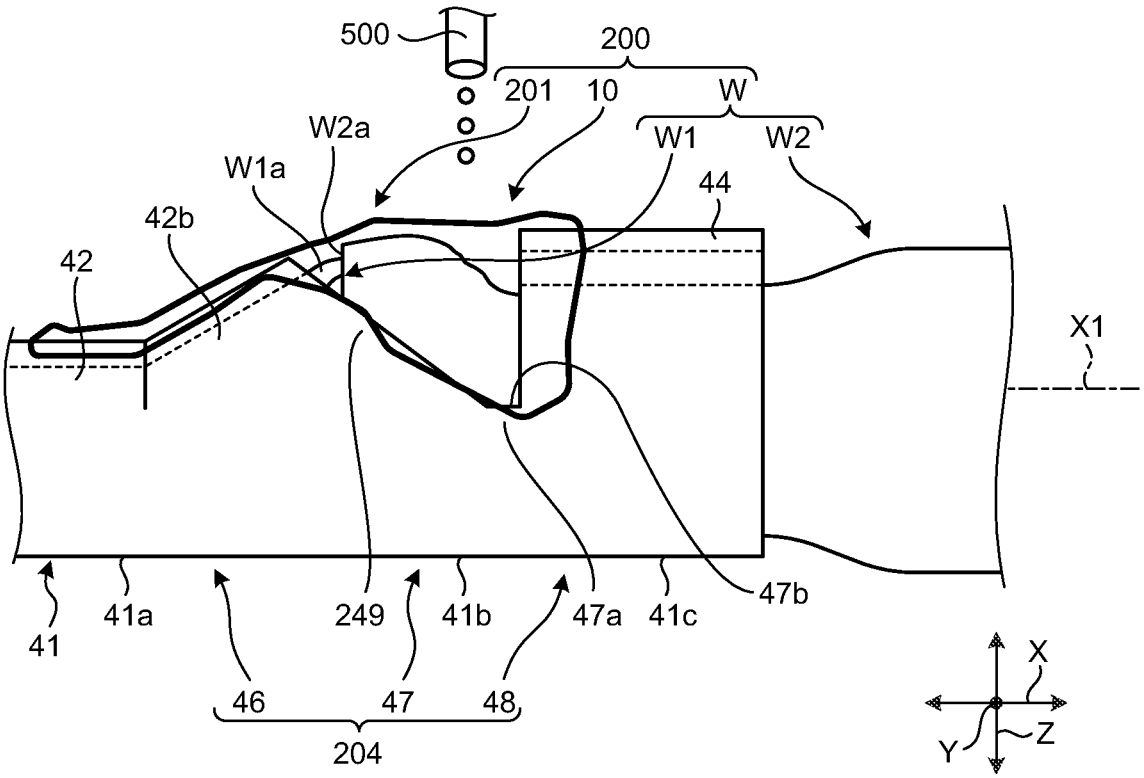
FIG. 11 is a schematic fragmentary side view illustrating a schematic configuration of the electric wire with terminal according to the second embodiment after applying an anticorrosive material.

Like the above-described sheath cover wall parts 49, the sheath cover wall parts 249 of the embodiment are formed as the wall parts that cover the edges W2*b* of the terminal W2*a* of the insulation sheath part W2 on a top view of the crimp terminal 1 illustrated in FIG. 8 and FIG. 10. There are a total of two sheath cover wall parts 249 with one each being provided by corresponding to the edges W2*b* on both sides in the width direction Y of the terminal W2*a* of the insulation sheath part W2 on the top view of the crimp terminal 1.

Furthermore, one each of the sheath cover wall parts 249 of the embodiment is provided, respectively, from each of the barrel pieces 42, 43 configuring the conductor crimp part 46 to the intermediate part 47. More specifically, each of the sheath cover wall parts 249 is formed in a substantially triangular shape from the end of each of the barrel pieces 42, 43 on the top end 42*a*, 43*a* sides to the end faces 47*b* of each of the rising end parts 47*a* of the intermediate part 47 (see FIG. 5, FIG. 6, and the like in particular).

One of the sheath cover wall parts 249 is provided from the barrel piece 42 to the end face 47*b* of the rising end part 47*a* on the barrel piece 42 side to cover the edge W2*b* of the terminal W2*a* of the insulation sheath part W2 on the barrel piece 42 side on the top view (FIG. 8, FIG. 10) of the crimp terminal 201 after the crimp terminal 201 is crimped to the electric wire W. The other sheath cover wall part 249 is provided from the barrel piece 43 to the end face 47*b* of the rising end part 47*a* on the barrel piece 43 side to cover the edge W2*b* of the terminal W2*a* of the insulation sheath part W2 on the barrel piece 43 side on the top view (FIG. 8, FIG. 10) of the crimp terminal 201 after the crimp terminal 201 is crimped to the electric wire W. In other words, each of the sheath cover wall parts 249 is formed to extend toward the end face 47*b* of the rising end part 47*a* from the end of each of the barrel pieces 42, 43 on the sheath crimp part 48 side, and formed such that the length thereof along the circumferential direction D1 becomes gradually shorter.

With such a configuration, on the top view of the crimp terminal 201 illustrated in FIG. 8 and FIG. 10, the terminal W2*a* of the insulation sheath part W2 is positioned within a range of the sheath cover wall parts 249 and the edges W2*b* of the terminal W2*a* are positioned on the inner side of the sheath cover wall parts 249. Herein, in a state after the crimp terminal 201 is crimped to the electric wire W as illustrated in FIG. 8, FIG. 9, FIG. 10, and FIG. 11, one of the sheath cover wall parts 249 continues to a bell mouth 42*b* formed at the end of the barrel piece 42 on the intermediate part 47 side, and the other sheath cover wall part 249 continues to a bell mouth 43*b* formed at the end of the barrel piece 43 on the intermediate part 47 side.

In the electric wire with terminal 200 configured in the manner described above, the edges W2*b* of the terminal W2*a* of the insulation sheath part W2 exposed from the intermediate part 47 are covered by each of the sheath cover wall parts 249, so that it is possible to prevent the edges W2*b* from covering over the end faces 47*b* side of the intermediate part 47. With the electric wire with terminal 200 having such a configuration, there is no edges W2*b* of the insulation sheath part W2 interposed between the application nozzle 500 (see FIG. 11) and each of the end faces 47*b* in the height direction Z, when applying the anticorrosive material 10 to the intermediate exposed part W1*a*, for example. Therefore, the anticorrosive material 10 can be applied properly on the whole surface of each of the end faces 47*b*. As a result, the anticorrosive material 10 of the embodiment can be applied to cover also the whole surface of the end faces 47*b* of the intermediate part 47 together with the intermediate exposed part W1*a*, so that the end faces 47*b* can also be protected from corrosion properly (see FIG. 7, FIG. 10, FIG. 11, and the like in particular).

Furthermore, in the electric wire with terminal 200, the edges W2*b* of the terminal W2*a* of the insulation sheath part W2 exposed from the intermediate part 47 are pressed down by each of the sheath cover wall parts 249. Therefore, when the crimp terminal 201 is swaged and crimped to the electric wire W, it is possible to prevent the terminal W2*a* side of the insulation sheath part W2 and the conductor part W1 in the vicinity of the terminal W2*a* from being protruded. As a result, with the electric wire with terminal 200, it is possible to suppress the amount of protrusion caused in the vicinity of the terminal W2*a* of the insulation sheath part W2 due to crimping. Thereby, with the electric wire with terminal 200, it is possible to suppress having a torn part generated in the insulation sheath part W2. Furthermore, it is also possible to easily cover the entire intermediate exposed part W1*a* of the conductor part W1 and the insulation sheath part W2 in the vicinity thereof with the anticorrosive material 10, so that corrosion can be prevented properly in this regards as well. Note that this is also the same with the electric wire with terminal 100 described above.

Like the electric wire with terminal 100, it is possible with the above-described electric wire with terminal 200 to perform various kinds of inspections regarding product management such as monitoring of poor crimping by checking the state of the terminal W2*a* of the insulation sheath part W2 exposed in the intermediate part 47. Furthermore, like the electric wire with terminal 100, it is possible with the electric wire with terminal 200 to suppress spread of the edges W2*b* of the terminal W2*a* by the sheath cover wall parts 249 when crimping the crimp terminal 201 to the electric wire W. In the electric wire with terminal 200 with such a configuration, the part including the conductor part W1 exposed from the crimp terminal 201 can be properly covered by the anticorrosive material 10 without being hindered by the edges W2*b* of the terminal W2*a* of the insulation sheath part. As a result, the electric wire with terminal 200 can secure a proper anticorrosion performance like the electric wire with terminal 100.

Note here that in the electric wire with terminal 200 described above, the sheath cover wall part 249 is provided, respectively, from each of the barrel pieces 42, 43 configuring the conductor crimp part 46 to the intermediate part 47. In the electric wire with terminal 200 with such a configuration, the edges W2*b* of the terminal W2*a* of the insulation sheath part W2 exposed in the intermediate part 47 can be properly covered by each of the sheath cover wall parts 249, so that the proper anticorrosion performance can be secured as described above. Moreover, compared to the electric wire with terminal 100 described above, it is possible with the electric wire with terminal 200 to increase the power to hold the conductor part W1 with the wire crimp part 204 due to the sheath cover wall parts 249 extended from each of the barrel pieces 42 and 43 configuring the conductor crimp part 46 so as to improve the connection reliability (electrical contact, mechanical holding power) between the conductor part W1 and the crimp terminal 201.

Furthermore, like the electric wire with terminal 100, it is possible with the electric wire with terminal 200 to apply the anticorrosive material 10 to cover also the end faces 47*b* of the intermediate part 47 together with the intermediate exposed part W1*a*, so that corrosion can be suppressed in the area in the vicinity of the end faces 47*b* where galvanic corrosion tends to occur. As a result, the electric wire with terminal 200 can secure a more proper anticorrosion performance.

Note that the above-described electric wire with terminal according to the embodiments of the present invention is not limited to the embodiments described above but various changes are possible within the scope of the appended claims.

While the anticorrosive material 10 is described above to be formed with a UV curable resin, it is not limited thereto and may be formed with a heat curable resin that is cured by applying heat, for example.

The electric wire with terminal according to the embodiments may be configured by combining the structural elements of the above-described embodiments and modification examples thereof as appropriate.

With the electric wire with terminal according to the present embodiments, the crimp terminal is crimped to the electric wire by crimping the conductor crimp part to the conductor part and crimping the sheath crimp part to the insulation sheath part. Furthermore, in the electric wire with terminal, the conductor part exposed from the crimp terminal is protected from corrosion by being covered by the anticorrosive material. In the electric wire with such a configuration, the terminal of the insulation sheath part is exposed together with the conductor part of the electric wire in the intermediate part that connects the conductor crimp part and the sheath crimp part. Furthermore, in the electric wire with terminal, the edges in the width direction of the terminal of the insulation sheath part exposed to the intermediate part are covered by the sheath cover wall parts on a top view when the conductor part exposed from the intermediate part is viewed from the exposed side of the conductor part along the exposing direction. With such a configuration, it is possible with the electric wire with terminal to properly cover the part including the conductor part exposed from the crimp terminal with the anticorrosive material without being hindered by the edges in the width direction of the terminal of the insulation sheath part. As a result, the electric wire with terminal can secure a proper anticorrosion performance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with terminal, comprising:

an electric wire having a conductor part exhibiting conductivity covered by an insulation sheath part exhibiting an insulating property;

a crimp terminal including a conductor crimp part crimped to the conductor part exposed from a terminal of the insulation sheath part, a sheath crimp part crimped to the insulation sheath part, and an intermediate part from which the conductor part is exposed along an exposing direction intersecting with an axial direction that is along an axis line of the electric wire, the intermediate part connecting the conductor crimp part and the sheath crimp part along the axial direction; and an anticorrosive material that covers the conductor part exposed from the crimp terminal, wherein the terminal of the insulation sheath part on a side of the conductor crimp part is exposed toward a side of the intermediate part from the sheath crimp part along the axial direction, and the crimp terminal includes a sheath cover wall part that, as viewed in a top view that is when the conductor part exposed from the intermediate part is viewed from an exposed side of the conductor part along the exposing direction, covers an edge of the terminal of the insulation sheath part in a width direction intersecting with the axial direction.

2. The electric wire with terminal according to claim 1, wherein the sheath crimp part includes a base extended along the axial direction with a plate-thickness direction of the base being along the exposing direction, and a pair of barrel pieces each being extended on both sides of a circumferential direction around the axis line from the base, the sheath crimp part being crimped by wrapping a whole circumference of the insulation sheath part in the circumferential direction with the base and the pair of barrel pieces, and the sheath cover wall part is provided from each of the barrel pieces to the intermediate part, respectively.

3. The electric wire with terminal according to claim 2, wherein an end face of the intermediate part in a circumferential direction around the axis line faces toward the exposed side of the conductor part along the exposing direction, and the anticorrosive material covers also the end face of the intermediate part.

4. The electric wire with terminal according to claim 1, wherein the conductor crimp part includes a base extended along the axial direction with a plate-thickness direction of the base being along the exposing direction, and a pair of barrel pieces each being extended on both sides of a circumferential direction around the axis line from the base, the conductor crimp part being crimped by wrapping a whole circumference of the conductor part in the circumferential direction with the base and the pair of barrel pieces, and the sheath cover wall part is provided from each of the barrel pieces to the intermediate part, respectively.

5. The electric wire with terminal according to claim 4, wherein an end face of the intermediate part in a circumferential direction around the axis line faces toward the exposed side of the conductor part along the exposing direction, and the anticorrosive material covers also the end face of the intermediate part.

6. The electric wire with terminal according to claim 1, wherein an end face of the intermediate part in a circumferential direction around the axis line faces toward the exposed side of the conductor part along the exposing direction, and the anticorrosive material covers also the end face of the intermediate part.

7. The electric wire with terminal according to claim 1, wherein, as viewed in the top view that is when the conductor part exposed from the intermediate part is viewed from the exposed side of the conductor part along the exposing direction, the width direction also intersects with the exposing direction.

* * * * *